US012799574B2

(12) United States Patent
Kawakami et al.

(10) Patent No.: US 12,799,574 B2
(45) Date of Patent: Nov. 17, 2026

(54) METHOD FOR MANUFACTURING HOT-DIP GALVANIZED STEEL SHEET AND METHOD FOR MANUFACTURING ALLOYED HOT-DIP GALVANIZED STEEL SHEET

(71) Applicant: Kobe Steel, Ltd., Kobe (JP)

(72) Inventors: Akira Kawakami, Kakogawa (JP); Hiroo Shige, Kakogawa (JP); Hiroshi Irie, Kakogawa (JP); Takayuki Maeda, Kakogawa (JP); Hang Yu, Fujisawa (JP)

(73) Assignee: Kobe Steel, Ltd., Kobe (JP)

( * ) Notice: Subject to any disclaimer, the term of this patent is extended or adjusted under 35 U.S.C. 154(b) by 436 days.

(21) Appl. No.: 18/548,244

(22) PCT Filed: Mar. 2, 2022

(86) PCT No.: PCT/JP2022/008964
§ 371 (c)(1),
(2) Date: Aug. 29, 2023

(87) PCT Pub. No.: WO2022/191008
PCT Pub. Date: Sep. 15, 2022

(65) Prior Publication Data

US 2024/0133013 A1 Apr. 25, 2024
US 2024/0229211 A9 Jul. 11, 2024

(30) Foreign Application Priority Data

Mar. 8, 2021 (JP) ..... 2021-036226
Feb. 1, 2022 (JP) ..... 2022-014412

(51) Int. Cl.
*C23C 2/06* (2006.01)
*C21D 8/0221* (2026.01)
(Continued)

(52) U.S. Cl.
CPC ..... *C23C 2/06* (2013.01); *C21D 8/0226* (2013.01); *C21D 8/0273* (2013.01); *C21D 9/46* (2013.01);
(Continued)

(58) Field of Classification Search
None
See application file for complete search history.

(56) References Cited

U.S. PATENT DOCUMENTS 6,398,884 B1 6/2002 Kyono et al.
2010/0304183 A1 12/2010 Honda et al.
(Continued)

FOREIGN PATENT DOCUMENTS

JP 6-136500 A 5/1994
JP 2007-239012 A 9/2007
(Continued)

OTHER PUBLICATIONS

Extended European Search Report issued on Dec. 13, 2024 in European Patent Application No. 22766967.8, 9 pages.
(Continued)

*Primary Examiner* — Seth Dumbris
(74) *Attorney, Agent, or Firm* — Oblon, McClelland, Maier & Neustadt, L.L.P.

(57) ABSTRACT

A method for manufacturing a hot-dip galvanized steel sheet having a high Si content and good plating adhesion. The method for manufacturing a hot-dip galvanized steel sheet includes the following: hot-rolling a steel raw material having a Si content of 1.0 mass % or more and coiling a steel sheet at 500° C. to 700° C.; subjecting a surface of the steel sheet after the coiling to an oxidation treatment at a heating temperature of a steel sheet temperature of 750° C. or lower, and subsequently subjecting the surface to a reduction treatment; and subjecting the steel sheet after the reduction
(Continued)

treatment to a hot-dip galvanizing treatment to form a Zn-plated layer on a surface of the steel sheet.

6 Claims, 1 Drawing Sheet

(51) Int. Cl.

| | |
|---|---|
| ***C21D 8/0247*** | (2026.01) |
| ***C21D 9/46*** | (2006.01) |
| ***C22C 38/00*** | (2006.01) |
| ***C22C 38/06*** | (2006.01) |
| ***C22C 38/34*** | (2006.01) |
| ***C22C 38/38*** | (2006.01) |
| ***C23C 2/02*** | (2006.01) |
| ***C23C 2/40*** | (2006.01) |

(52) U.S. Cl.
CPC ..... *C22C 38/002* (2013.01); *C22C 38/06* (2013.01); *C22C 38/34* (2013.01); *C22C 38/38* (2013.01); *C23C 2/0222* (2022.08); *C23C 2/40* (2013.01)

(56) References Cited

U.S. PATENT DOCUMENTS

| | | | | |
|---|---|---|---|---|
| 2012/0325376 | A1* | 12/2012 | Makimizu | C23G 1/081 148/284 |
| 2014/0174608 | A1 | 6/2014 | Miyata et al. | |
| 2014/0234660 | A1 | 8/2014 | Kawata et al. | |
| 2016/0002807 | A1* | 1/2016 | Taira | B32B 15/013 148/241 |
| 2016/0108492 | A1 | 4/2016 | Zhong et al. | |
| 2016/0160335 | A1 | 6/2016 | Ikeda | |
| 2017/0088914 | A1* | 3/2017 | Ikeda | C22C 38/28 |
| 2017/0137906 | A1 | 5/2017 | Fan et al. | |
| 2017/0253943 | A1 | 9/2017 | Makimizu et al. | |
| 2017/0369965 | A1* | 12/2017 | Ikeda | C21D 8/0226 |
| 2018/0002799 | A1* | 1/2018 | Futamura | C23C 2/29 |
| 2018/0281348 | A1 | 10/2018 | Otomo et al. | |
| 2019/0256942 | A1* | 8/2019 | Fan | C21D 9/46 |
| 2019/0368002 | A1* | 12/2019 | Hayashi | C21D 6/008 |

FOREIGN PATENT DOCUMENTS

| | | | |
|---|---|---|---|
| JP | 2010-116590 | A | 5/2010 |
| JP | 2010-132975 | A | 6/2010 |
| JP | 2019-77933 | A | 5/2019 |
| WO | WO-2006/106999 | A1 | 10/2006 |

OTHER PUBLICATIONS

International Search Report issued May 17, 2022 in PCT/JP2022/008964, filed on Mar. 2, 2022, 3 pages.
International Preliminary Report on Patentability with Written Opinion issued on Sep. 21, 2023 in PCT/JP2022/008964, 7 pages.

* cited by examiner

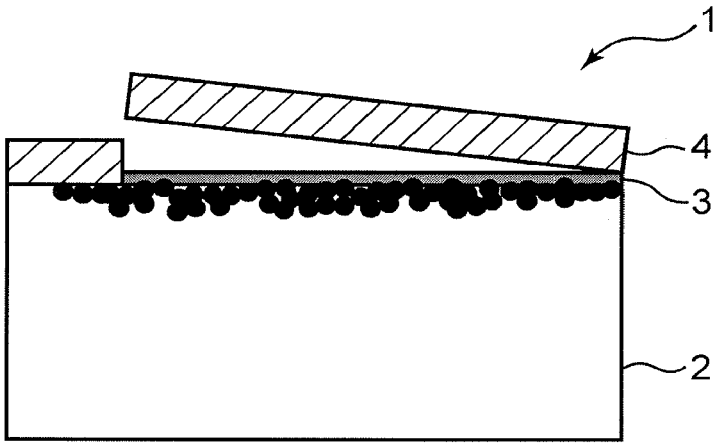
1
4
3
2

METHOD FOR MANUFACTURING HOT-DIP GALVANIZED STEEL SHEET AND METHOD FOR MANUFACTURING ALLOYED HOT-DIP GALVANIZED STEEL SHEET

CROSS REFERENCE TO RELATED APPLICATIONS

This application is a National Stage entry under 35 U.S.C. § 371 of PCT/JP2022/008964, filed on Mar. 2, 2022, and claims priority to Japanese Patent Application No. 2021-036226, filed on Mar. 8, 2021, and Japanese Patent Application No. 2022-014412, filed on Feb. 1, 2022, the entire contents of which are incorporated herein by reference.

TECHNICAL FIELD

The present invention relates to a method for manufacturing a high-strength and high-formability hot-dip galvanized steel sheet and a method for manufacturing a hot-dip galvannealed steel sheet, having a high Si content.

BACKGROUND ART

In the automobile industry, weight reduction and strength enhancement of an automobile member such as an automobile body are required from the viewpoint of improving fuel efficiency for reducing $CO_2$ and improving crashworthness. Thus, an ultra-high-strength steel sheet having a tensile strength of 980 MPa or more is applied to the automobile member such as the automobile body. In order to improve the formability of such a high-strength steel sheet, a method is known in which inexpensive Si is contained in a chemical composition of the steel sheet. When Si is contained in the chemical composition of the steel sheet, not only the strength but also the formability of the steel sheet can be improved.

In general, when Si-added steel is applied to the automobile member, a hot-dip galvanized steel sheet (GI steel sheet) and a hot-dip galvannealed steel sheet (GA steel sheet) obtained by alloying the hot-dip galvanized steel sheet are used from the viewpoint of securing corrosion resistance and weldability. However, in the hot-dip galvanized steel sheet in which Si is added to the steel sheet, since an Si oxide layer covers a steel sheet surface in the manufacturing process, problems such as bare spot, reduction in plating adhesion, and an alloying unevenness in alloying treatment are likely to occur finally. In addition, problems such as peeling of the plating during processing of the hot-dip galvannealed steel sheet may also occur. In order to suppress such a problem caused by the addition of Si, the hot-dip galvanized steel sheet containing Si in a steel raw material is often manufactured using an oxidation-reduction method using an annealing furnace having an oxidation heating zone and a reduction heating zone. According to the oxidation-reduction method, since iron oxide generated in the oxidation heating zone generates a reduced Fe layer during reduction annealing, plating wettability during plating can be improved. In addition, a method of forming an internal oxide layer containing $SiO_2$ and the like necessary for plating in advance in a steel sheet by increasing a coiling temperature in hot rolling is also used.

In recent years, in order to further improve the strength and formability of the hot-dip galvanized steel sheet, various developments have been made on a method of favorably forming a hot-dip galvanized steel sheet or an internal oxide layer in which an Si content of the steel sheet is increased to 1 mass % or more.

Specifically, for example, Patent Literature 1 describes a high-strength hot-dip galvannealed steel sheet with a good appearance containing Fe on a high-strength steel sheet containing C: 0.05 to 0.25%, Si: 0.3 to 2.5%, Mn: 1.5 to 2.8%, P: 0.03% or less, S: 0.02% or less, Al: 0.005 to 0.5%, and N: 0.0060% or less in terms of mass %, with the balance being Fe and unavoidable impurities, and having a hot-dip galvannealed layer containing Zn and unavoidable impurities as the balance, in which an oxide containing Si at a crystal grain boundary on a steel sheet side of 5 μm or less from an interface between a high-strength steel sheet and a plating layer and within the crystal grains is present at an average content of 0.6 to 10 mass %, and an oxide containing Si is present in the plating layer at an average content of 0.05 to 1.5 mass %.

In addition, for example, Patent Literature 2 describes a method for manufacturing a high-strength hot-dip galvanized steel sheet having excellent plating adhesion, formability, and appearance, and this method includes a hot rolling step of hot rolling a slab containing C: 0.05 to 0.30%, Si: 0.1 to 2.0%, and Mn: 1.0 to 4.0% in terms of mass %, then coiling the steel sheet into a coil at a specific temperature $T_C$, and pickling the steel sheet, a cold rolling step of cold rolling the hot-rolled steel sheet resulting from the hot rolling step, an annealing step of annealing the cold-rolled steel sheet resulting from the cold rolling step under specific conditions, and a hot-dip galvanizing step of hot-dip galvanizing the annealed sheet resulting from the annealing step in a hot-dip galvanizing bath containing 0.12 to 0.22 mass % Al.

In addition, for example, Patent Literature 3 describes a cold-rolled steel sheet obtained by heat-treating a raw steel piece in a temperature range of 650 to 950° C. in an atmosphere in which reduction does not substantially occur after hot rolling while keeping adhesion of a black scale, thereby forming an internal oxide layer on a surface portion of a base steel sheet of the steel sheet, and then performing pickling, cold rolling, and recrystallization annealing according to a conventional method.

CITATION LIST

Patent Literature

Patent Literature 1: JP 2006-233333 A
Patent Literature 2: WO 2016/038801 A
Patent Literature 3: JP 2000-309824 A

SUMMARY OF INVENTION

An object of the present invention is to provide a method for manufacturing a hot-dip galvanized steel sheet having a high Si content and good plating adhesion.

As a result of intensive studies to solve the above problems, the present inventors have accomplished the present invention.

That is, a method for manufacturing a hot-dip galvanized steel sheet according to a first aspect of the present invention includes the steps of: hot-rolling a steel raw material having a Si content of 1.0 mass % or more and coiling a steel sheet at 500° C. to 700° C.; subjecting a surface of the steel sheet after the coiling to an oxidation treatment at a heating temperature of a steel sheet temperature of 750° C. or lower, and subsequently subjecting the surface to a reduction treatment; and subjecting the steel sheet after the reduction treatment to a hot-dip galvanizing treatment to form a Zn-plated layer on a surface of the steel sheet.

A method for manufacturing a hot-dip galvannealed steel sheet according to a second aspect of the present invention further includes a step of alloying the Zn-plated layer formed on the hot-dip galvanized steel sheet obtained by the method for manufacturing a hot-dip galvanized steel sheet according to the first aspect described above.

BRIEF DESCRIPTION OF DRAWINGS

FIG. 1 is a schematic view of a hot-dip galvannealed steel sheet in a case where a fayalite layer is formed.

DESCRIPTION OF EMBODIMENTS

As described above, the techniques described in Patent Literatures 1 to 3 relate to a method for manufacturing a hot-dip galvanized steel sheet or the like in which an Si content of a steel sheet is increased to 1 mass % or more, and a method for forming an internal oxide layer well.

However, when the Si content is increased to 1 mass % or more in order to obtain a high-strength and high-formability hot-dip galvanized steel sheet having a tensile strength of 980 MPa or more, it is difficult to obtain a hot-dip galvanized steel sheet having good plating adhesion only by applying the conventional method. In particular, as compared with the vicinity of a center in a coil width direction of the steel sheet (hereinafter, also simply referred to as "width direction center"), it is difficult to ensure good plating adhesion in the vicinity of an edge of the steel sheet in the coil width direction (hereinafter, also simply referred to as "width direction edge").

Specifically, in the case of using high Si-added steel, when the coil is cooled after coiling in hot rolling, the coil is steeply cooled in the vicinity of the width direction edge of the steel sheet. Thus, in the vicinity of the width direction edge of the steel sheet, the internal oxide layer hardly grows, and a layer is formed thin. On the other hand, in the vicinity of the width direction center of the steel sheet, the internal oxide layer sufficiently grows, and a layer is formed thick. In addition, in the internal oxide layer in the vicinity of the width direction edge of the steel sheet, grain boundary oxidation that is hardly dissolved by pickling is thin. Thus, in the subsequent pickling step, the internal oxide layer in the vicinity of the width direction edge of the steel sheet is preferentially dissolved rather than the vicinity of the width direction center of the steel sheet, and a large amount of $SiO_2$ that is intragranularly oxidized remains on the surface of the steel sheet. As a result, $SiO_2$ on the surface of the steel sheet reacts with FeO generated by oxidation of the surface of the steel sheet at the time of the oxidation treatment in the subsequent oxidation-reduction method, and a thick fayalite layer ($(FeO)_2 \cdot SiO_2$ layer) is formed between the steel sheet and plating after annealing. When the fayalite layer is formed, the plating adhesion deteriorates after plating, which is the subsequent step, and plating is likely to be peeled off after alloying. FIG. 1 shows a schematic view of a hot-dip galvannealed steel sheet in the case where the fayalite layer is formed. In FIG. 1, each reference sign represents a hot-dip galvannealed steel sheet 1, a steel sheet 2, a fayalite layer 3, or a plating layer 4. As shown in FIG. 1, in the hot-dip galvannealed steel sheet 1, the plating layer 4 is peeled off from the steel sheet 2 due to the fayalite layer 3 formed on a surface of the steel sheet 2.

Such a problem cannot be solved even by using the techniques described in the above-described Patent Literatures. For example, even in the method for manufacturing a steel sheet described in Patent Literature 1, the rapid cooling of the coil in the vicinity of the width direction edge is not taken into consideration, so that it is difficult to make a thickness of the internal oxide layer uniform in the width direction of the steel sheet, and a large amount of $SiO_2$ tends to remain on the surface in the vicinity of the width direction edge of the steel sheet. In the manufacturing method described in Patent Literature 2, since it is necessary to lower a coiling temperature as the contents of Si and Mn increase, it is considered that it is difficult to generate a predetermined amount of oxide in the vicinity of the width direction edge and $SiO_2$ tends to remain on the surface of the steel sheet. As a result, even if the techniques disclosed in Patent Literatures 1 and 2 are used, a fayalite layer may be formed, and it is difficult to obtain uniform and good plating adhesion in the width direction of the steel sheet. On the other hand, according to the manufacturing method described in Patent Literature 3, since the temperature of the heat treatment is high, a reduced Fe layer covering the surface cannot be removed by pickling. As a result, contamination of the steel sheet and decarburization in the vicinity of the surface of the steel sheet proceed, and thus it becomes difficult to obtain a steel sheet having a predetermined strength, for example, a tensile strength as high as 980 MPa.

Thus, the present inventors have conducted various studies on a method for manufacturing a hot-dip galvanized steel sheet having good plating adhesion using the steel sheet having a high Si content. Then, the present inventors have focused on suppressing the formation of a fayalite layer during heating in the oxidation treatment, and completed the present invention. Specifically, it has been found that the formation of the fayalite layer can be suppressed by setting the heating temperature in the oxidation treatment in the oxidation-reduction method to a steel sheet temperature of 750° C. or lower at the time of manufacturing the hot-dip galvanized steel sheet. As a result, it has been found that a high-strength and high-formability hot-dip galvanized steel sheet having good plating adhesion even in the vicinity of the width direction edge of the steel sheet can be obtained. The hot-dip galvanized steel sheet and the hot-dip galvannealed steel sheet obtained by alloying the plating layer thus obtained can have a tensile strength of, for example, 980 MPa or more.

That is, according to the present invention, it is possible to provide a method for manufacturing a hot-dip galvanized steel sheet having a high Si content and good plating adhesion.

Hereinafter, an embodiment of the present invention will be described in detail. Note that, the scope of the present invention is not limited to the embodiment described herein, and various modifications can be made without departing from the spirit of the present invention.

In the present specification, the "internal oxide layer" means an internal oxide layer containing $SiO_2$ (including oxidized portions of both grain boundary oxidation and intragranular oxidation) that can be generated inside the steel sheet during heating in hot rolling and annealing before pickling (in other words, "annealing after hot rolling and before annealing by the oxidation-reduction method"; the same applies hereinafter). In addition, the internal oxide layer is present between a surface layer of the steel sheet subjected to the hot-dip galvanizing treatment and a steel sheet base portion which is an inner portion of the steel sheet not containing an oxide such as $SiO_2$.

In the present specification, unless a specific position is indicated, the "edge in the coil width direction (of the steel sheet)" or the "width direction edge" basically intends both edges in the coil width direction, that is, both ends in a sheet width direction. In addition, in the present specification, "the vicinity of the edge in the coil width direction (of the steel sheet)" or "the vicinity of the width direction edge" means a peripheral portion of the position of the edge in the coil width direction. When a specific position is indicated from the edge in the coil width direction, a distance from the width direction edge (in other words, the position of 0 mm in the width direction) is also described.

In the present specification, the "center in the coil width direction (of the steel sheet)" or the "width direction center" means the center of the steel sheet in the sheet width direction. In addition, in the present specification, "the vicinity of the center in the coil width direction (of the steel sheet)" or "the vicinity of the width direction center" means a peripheral portion of the position of the center in the coil width direction.

In the present specification, a "rear end in a rolling direction (of the steel sheet)" means a position of the rear end in a direction parallel to the rolling direction of the steel sheet for hot-dip galvanizing, that is, a position of a rearmost end of 0 mm. In addition, in the present specification, "the vicinity of the rear end in the rolling direction (of the steel sheet)" means a peripheral portion of a position of the rear end in the rolling direction.

In the present specification, a "front end in a rolling direction (of the steel sheet)" means a position of the front end in the direction parallel to the rolling direction of the steel sheet for hot-dip galvanizing, that is, a position of a frontmost end of 0 mm. In addition, in the present specification, "the vicinity of the front end in the rolling direction (of the steel sheet)" means a peripheral portion of a position of the front end in the rolling direction.

1. Method for Manufacturing Hot-Dip Galvanized Steel Sheet and Hot-Dip Galvannealed Steel Sheet The method for manufacturing a hot-dip galvanized steel sheet according to the present embodiment includes the steps of: hot-rolling a steel raw material (steel or steel sheet) having a Si content of 1.0 mass % or more and coiling a steel sheet at 500° C. to 700° C.; subjecting a surface of the steel sheet after the coiling to an oxidation treatment at a heating temperature of a steel sheet temperature of 750° C. or lower, and subsequently subjecting the surface to a reduction treatment; and subjecting the steel sheet after the reduction treatment to a hot-dip galvanizing treatment to form a Zn-plated layer on a surface of the steel sheet.

Hereinafter, each step and optional steps before and after each step will be described in detail.

(Provision of Steel Raw Material for Rolling)

First, a steel raw material such as a slab for rolling having a chemical composition in which the Si content is 1.0 mass % or more is prepared. The chemical composition of the steel raw material will be described in detail later. The steel raw material such as a slab can be provided by any known method. Examples of a method for preparing the slab include a method in which steel having a chemical composition described later is produced, and the slab is prepared by ingot-making or continuous casting. If necessary, a cast material obtained by ingot-making or continuous casting may be subjected to blooming and billet-making to obtain a slab.

(Hot Rolling)

Next, hot rolling is performed using the obtained steel raw material such as a slab to obtain a hot-rolled steel sheet.

Although the hot rolling may be performed by a method under any known conditions, the coiling temperature is set to 500° C. to 700° C. By setting the coiling temperature to 500° C. or higher, the internal oxide layer can be sufficiently grown, and it is possible to prevent $SiO_2$ from being exposed and dissolved on the surface of the steel sheet in the vicinity of the width direction edge after the subsequent steps, leading to the formation of the fayalite layer. The coiling temperature is preferably 520° C. or higher, and more preferably 530° C. or higher. By setting the coiling temperature to 700° C. or lower, it is possible to avoid that an amount of reduced iron generated by cooling after hot rolling increases, and removal by subsequent pickling becomes difficult. The coiling temperature is preferably 680° C. or lower, and more preferably 660° C. or lower.

Other conditions at the time of hot rolling are not particularly limited. For example, in the hot rolling, the slab before hot rolling may be soakingly retained at a temperature of 1000° C. to 1300° C. or lower according to a conventional method, a finish rolling temperature may be set to 800° C. or higher, and then the slab may be coiled as a coiled steel sheet. In addition, the coiled hot-rolled steel sheet after hot rolling may be naturally cooled to normal temperature.

(Annealing)

In addition, the coiled steel sheet is preferably annealed at a soaking temperature of 540° C. to 620° C. under a non-reducing atmosphere.

In the present specification, "under the non-reducing atmosphere" means under a gas atmosphere in which the surface of the steel sheet is not substantially reduced. Although not limited, for example, a gas atmosphere such as $N_2$-less than 1.0 vol % $H_2$, argon, or atmosphere is preferable.

By setting the soaking temperature during annealing to 540° C. or higher, the internal oxide layer can be grown well and remain to the vicinity of the width direction edge of the steel sheet. As a result, a hot-dip galvanized steel sheet that can be alloyed without unevenness can be obtained. In addition, it is more preferable that the internal oxide layer is grown well and remains not only from the vicinity of the width direction center of the steel sheet to the vicinity of the width direction edge but also from the vicinity of the front end in the rolling direction to the vicinity of the rear end in the rolling direction of the steel sheet. As a result, it is possible to obtain a hot-dip galvanized steel sheet that can be alloyed substantially uniformly and reliably without unevenness on substantially the entire surface of the steel sheet. It is difficult to sufficiently grow the internal oxide layer up to the vicinity of the width direction edge only by the heating at the time of coiling during the hot rolling described above. By setting the soaking temperature during annealing to 620° C. or lower, it is possible to avoid that removal of scale by subsequent pickling becomes difficult. The soaking temperature during annealing is more preferably 550° C. or higher. Furthermore, the soaking temperature during annealing is more preferably 610° C. or lower.

The soaking time during annealing is not particularly limited, and may be controlled to a suitable time for obtaining a desired internal oxide layer in consideration of the conditions of hot rolling (particularly the coiling temperature), the soaking temperature in this step, and the pickling conditions in the subsequent step. For example, by ensuring 30 hours or more as the soaking time during annealing, a plated substrate having a desired internal oxide layer can be obtained. The upper limit of the soaking time during annealing is not particularly limited, and for example, if the soaking time is not excessively longer than 30 hours, it is possible to prevent deterioration of productivity.

(Pickling)

The annealed steel sheet is then preferably pickled. The pickling method is not particularly limited, and any known method may be applied. For example, the scale may be removed by immersion using hydrochloric acid or the like.

The pickling is preferably performed while being adjusted to such an extent that the scale adhering to the steel sheet is removed. Specifically, for example, the pickling is preferably performed so that a pickling reduction amount (that is, a weight reduction amount per area of the steel sheet) in the steel sheet after removing the scale is less than 31 $g/m^2$. By setting the pickling reduction amount to less than 31 $g/m^2$, it is possible to prevent some base steel sheet crystal grains in the internal oxide layer on the surface of the steel sheet from dissolving, peeling off, and falling off particularly in the vicinity of the width direction edge of the steel sheet, and thus to prevent $SiO_2$ from exposing and dispersing on the surface of the steel sheet. This makes it possible to reliably suppress the formation of the fayalite layer after plating treatment and to obtain a hot-dip galvanized steel sheet having more excellent plating adhesion.

As the pickling reduction amount, the desired pickling reduction amount described above can be achieved by suitably controlling the type of a pickling liquid (for example, hydrochloric acid liquid), the concentration of the pickling liquid, the temperature of the pickling liquid, and a pickling time. For example, a hydrochloric acid concentration may be set to preferably 3 mass % or more, and more preferably 5 mass % or more. The hydrochloric acid concentration may be set to, for example, preferably 20 mass % or less, and more preferably 15 mass % or less. In addition, for example, the temperature of the pickling liquid may be set to preferably 60° C. or higher, and more preferably 70° C. or higher. Furthermore, the temperature of the pickling liquid may be set to preferably 90° C. or lower, and more preferably 80° C. or lower. The pickling time may be appropriately adjusted according to the concentration and temperature of the pickling liquid so that, for example, the pickling reduction amount is less than 31 $g/m^2$.

(Cold Rolling)

In addition, the steel sheet after pickling may be cold-rolled. The cold rolling method is not particularly limited, and any known method may be applied. For example, in order to obtain a desired sheet thickness, a cold rolling ratio in the cold rolling can be set in a range of 10% to 70%. The sheet thickness of the steel sheet is not particularly limited.

(Oxidation Treatment and Reduction Treatment)

Next, annealing by the oxidation-reduction method is applied to the surface of the obtained steel sheet. First, the surface of the steel sheet is subjected to an oxidation treatment to form an Fe oxide layer on the surface of the steel sheet. In addition, the Fe oxide layer is subjected to a reduction treatment (also referred to as "reduction annealing treatment" in the present specification) under a reducing atmosphere to form a reduced Fe layer. At this time, oxygen supplied from the Fe oxide layer by reduction oxidizes Si and Mn inside the steel sheet. That is, by applying annealing by such an oxidation-reduction method, the Fe oxide layer becomes a barrier layer, an oxide of Si can be kept inside the steel sheet, and oxidation of Si in the vicinity of the surface of the steel sheet can be suppressed. As a result, wettability to hot-dip galvanization can be improved, and finally the plating adhesion can also be improved.

The oxidation treatment and the reduction treatment may be performed using any known single facility or a plurality of any known facilities. Preferably, equipment of a continuous galvanizing line (CGL) is used from the viewpoint of manufacturing efficiency, cost, and quality retention. By using the continuous galvanizing line, an oxidation treatment and a reduction treatment by the oxidation-reduction method, and a hot-dip galvanizing treatment and an alloying treatment described later can be continuously performed in a series of manufacturing lines. More specifically, the oxidation treatment and the reduction treatment by the oxidation-reduction method are more preferably performed using, for example, an annealing furnace in the continuous hot-dip galvanization line of a non-oxygen furnace (NOF) type or a direct fired furnace (DFF) type.

The oxidation treatment is applied to the surface of the steel sheet at a heating temperature of the steel sheet temperature of 750° C. or lower, for example, in the oxidation heating zone in a NOF-type or DFF-type annealing furnace. By setting the steel sheet temperature to 750° C. or lower, it is possible to suppress a reaction between $SiO_2$ and FeO generated by the oxidation treatment particularly on a surface in the vicinity of the width direction edge of the steel sheet. As a result, it is possible to prevent the formation of the fayalite layer after annealing and to obtain a hot-dip galvanized steel sheet having good plating adhesion.

In the present specification, the "steel sheet temperature" during heating in the oxidation treatment means a maximum reached sheet temperature of the steel sheet whose heating is controlled in the oxidation heating zone.

The steel sheet temperature in the oxidation treatment is preferably 730° C. or lower, more preferably 720° C. or lower, and still more preferably 700° C. or lower. The lower limit of the steel sheet temperature in the oxidation treatment is not particularly limited, and may be a temperature at which the Fe oxide layer is formed on the surface of the steel sheet under a gas atmosphere described later. For example, the steel sheet temperature in the oxidation treatment is preferably 650° C. or higher, and more preferably 670° C. or higher.

A temperature rise time in the oxidation treatment is not particularly limited, and may be adjusted so that the fayalite layer is not formed by the oxidation treatment due to an excessively long temperature rise time. Specifically, the temperature rise time in the oxidation treatment may be suitably adjusted in consideration of the conditions of hot rolling (particularly the coiling temperature), the annealing conditions before pickling, the pickling conditions, and the temperature of the steel sheet during heating in the oxidation treatment. For example, the temperature rise time in the oxidation treatment is preferably 10 seconds or more, and more preferably 15 seconds or more. Furthermore, for example, the temperature rise time in the oxidation treatment is preferably 120 seconds or less, and more preferably 90 seconds or less.

The oxidation treatment is not particularly limited, and can be performed, for example, under a gas atmosphere containing $O_2$, $CO_2$, $N_2$, and $H_2O$. More specifically, the oxidation treatment can be performed in a combustion gas such as cokes oven gas (COG) or liquefied petroleum gas (LPG) in, for example, the NOF-type or DFF-type annealing furnace or the like under a gas atmosphere in which a concentration of unburned $O_2$ is controlled. The $O_2$ concentration is preferably controlled in a range of 100 ppm to 17,000 ppm. The $O_2$ concentration is more preferably controlled at 500 ppm or more, and still more preferably 2,000 ppm or more. Furthermore, the $O_2$ concentration is more preferably controlled at 15,000 ppm or less, and still more preferably 13,000 ppm or less.

The heating temperature (soaking temperature) of the steel sheet in the reduction annealing treatment is not particularly limited, and may be performed at a temperature at which the Fe oxide layer formed by the oxidation treatment becomes the reduced Fe layer. Specifically, reduction annealing is preferably performed at a soaking temperature of preferably an $Ac_3$ point or higher. The $Ac_3$ point can be calculated by the following formula (i) ("The Physical Metallurgy of Steels, Leslie", (published by Maruzen Co., Ltd., written by William C. Leslie, p. 273)). A symbol of each element enclosed by [ ] in the formula (i) denotes the content (mass %) of the element.

$$Ac_3(^\circ\,C.)=910-203\times[C]^{1/2}-15.2\times[Ni]+44.7\times[Si]+104\times[V]+31.5\times[Mo]+13.1\times[W]-\{30\times[Mn]+11\times[Cr]+20\times[Cu]-700\times[P]-400\times[Al]-120\times[As]-400\times[Ti]\} \quad (i)$$

The heating time (soaking time) in the reduction treatment is not particularly limited, and may be appropriately adjusted so that the Fe oxide layer formed by the oxidation treatment becomes the reduced Fe layer. For example, the heating time in the reduction treatment is preferably 30 seconds or more, and more preferably 45 seconds or more. Furthermore, the heating time in the reduction treatment is preferably 600 seconds or less, and more preferably 500 seconds or less.

The reduction annealing treatment can be performed by any known treatment method, for example, in the reduction heating zone in the NOF-type or DFF-type annealing furnace. Specifically, the reduction annealing treatment can be performed by heating the surface of the steel sheet under a reducing atmosphere mainly containing $H_2$ gas and an inert gas such as $N_2$. When a mixed gas containing $H_2$ gas and an inert gas such as $N_2$ is used, for example, the $H_2$ gas can be contained in a proportion of 3 vol % to 25 vol %, and an inert gas such as $N_2$ can be contained as the balance.

(Hot-Dip Galvanizing Treatment)

In addition, a hot-dip galvanized steel sheet in the present embodiment can be manufactured by subjecting the steel sheet after the reduction treatment to a hot-dip galvanizing treatment to form a Zn-plated layer on the surface of the steel sheet.

The method of the hot-dip galvanizing treatment is not particularly limited, and any known method may be applied. For example, the Zn-plated layer can be formed on the surface of the steel sheet by immersing the steel sheet in a Zn-plating bath at a steel sheet temperature of about 400° C. to 500° C. In addition, the immersion time of the steel sheet in the Zn-plating bath may be adjusted according to a desired Zn-plating adhesion amount.

(Alloying Treatment)

The method for manufacturing a hot-dip galvannealed steel sheet according to the present embodiment further includes a step of alloying the Zn-plated layer formed on the hot-dip galvanized steel sheet obtained by the above-described method.

Specifically, by heating the hot-dip galvanized steel sheet at a predetermined alloying temperature, Fe atoms contained in the steel sheet diffuse into the Zn-plated layer, and the Zn-plated layer can be alloyed. The alloying method is not particularly limited, and any known method may be applied. The alloying temperature is not particularly limited, and can be set to, for example, preferably 460° C. to 650° C. The heating time at the alloying temperature is also not particularly limited, and can be set to, for example, preferably 10 seconds to 40 seconds. In addition, the heating of the alloying can be, for example, under an air atmosphere.

2. Chemical Composition of Steel Raw Material

The chemical composition of the steel raw material used in the method for manufacturing a hot-dip galvanized steel sheet and the method for manufacturing a hot-dip galvannealed steel sheet in the present embodiment is not particularly limited except for Si. Hereinafter, an example of the chemical composition of the steel raw material will be described.

[Si: 1 Mass % or More]

Si is an inexpensive steel reinforcing element, and hardly affects the formability of the steel sheet. In addition, Si is an element capable of suppressing generation of carbide due to decomposition of retained austenite useful for improving the formability of the steel sheet. In order to allow such an effect to be effectively exhibited, the Si content is 1.0 mass % or more, preferably 1.1 mass % or more, and more preferably 1.2 mass % or more. The upper limit of the Si content is not particularly limited, and when the Si content is too large, there is a possibility that solid-solution strengthening action by Si becomes remarkable and a rolling load increases, and there is a possibility that Si scale is generated during hot rolling to cause surface defects of the steel sheet. Thus, for example, the Si content is preferably 3.0 mass % or less, more preferably 2.7 mass % or less, and still more preferably 2.5 mass % or less from the viewpoint of manufacturing stability.

[Mn: Preferably 1.5 Mass % or More and 3.0 Mass % or Less]

Mn is also an inexpensive steel reinforcing element, similarly to Si, and is effective for improving the strength of the steel sheet. Mn is a particularly effective reinforcing element in order to ensure the tensile strength of the hot-dip galvanized steel sheet of finally 980 MPa or more by adding Si, and optionally also C, to the steel. In addition, Mn is an element that stabilizes austenite and contributes to improvement of the formability of the steel sheet by generation of retained austenite. In order to allow such an effect to be effectively exhibited, the Mn content is preferably 1.5 mass % or more, more preferably 1.8 mass % or more, and still more preferably 2.0 mass % or more. However, when the Mn content is too large, ductility of the steel sheet is reduced, which adversely affects the formability of the steel sheet, and the weldability of the steel sheet may be reduced. From such a viewpoint, the Mn content is preferably 3.0 mass % or less, more preferably 2.8 mass % or less, and still more preferably 2.7 mass % or less.

[C: Preferably 0.08 Mass % or More and 0.30 Mass % or Less]

C is an element effective for improving the strength of the steel sheet, and is a particularly effective reinforcing element in order to ensure the tensile strength of the hot-dip galvanized steel sheet of finally 980 MPa or more by adding Si, and optionally also Mn, to the steel. Furthermore, C is an element necessary for securing retained austenite and improving the formability. In order to allow such an effect to be effectively exhibited, the C content is preferably 0.08 mass % or more, more preferably 0.11 mass % or more, and still more preferably 0.13 mass % or more. From the viewpoint of ensuring the strength of the steel sheet, it is preferable that the C content is large; however, when the C content is too large, corrosion resistance, spot weldability, and formability may deteriorate. Thus, the C content is preferably 0.30 mass % or less, more preferably 0.25 mass % or less, and still more preferably 0.20 mass % or less.

[P: Preferably More than 0 Mass % and 0.1 Mass % or Less]

P is an element inevitably present as an impurity element. When the P content is excessive, the weldability of the steel sheet may be deteriorated. Thus, the P content is preferably 0.1 mass % or less, more preferably 0.08 mass % or less, and still more preferably 0.05 mass % or less.

[S: Preferably More than 0 Mass % and 0.05 Mass % or Less]

S is an element inevitably present as an impurity element. Usually, steel inevitably contains S in an amount of about 0.0005 mass %. When the S content is excessive, a sulfide-based inclusion is formed, hydrogen absorption is promoted under a corrosive environment, delayed fracture resistance of the steel sheet is deteriorated, and the weldability and formability of the steel sheet may be deteriorated. Thus, the S content is preferably 0.05 mass % or less, more preferably 0.01 mass % or less, and still more preferably 0.005 mass % or less.

[Al: Preferably More than 0 Mass % and 1.0 Mass % or Less]

Al is an element having a deoxidizing action. In order to allow such an effect to be effectively exhibited, the Al content is preferably more than 0 mass %, more preferably 0.005 mass % or more, and still more preferably 0.02 mass % or more. When the Al content is excessive, inclusions such as alumina increase, and the formability of the steel sheet may deteriorate. Thus, the Al content is preferably 1.0 mass % or less, more preferably 0.8 mass % or less, and still more preferably 0.5 mass % or less.

[Cr: Preferably More than 0 Mass % and 1.0 Mass % or Less]

Cr is an element effective for improving the strength of the steel sheet. Furthermore, Cr is an element that improves the corrosion resistance of the steel sheet, and has an action of suppressing generation of hydrogen due to corrosion of the steel sheet. Specifically, Cr has an action of promoting the production of iron oxide ($\alpha$-FeOOH). Iron oxide is said to be thermodynamically stable and protective among rusts produced in the atmosphere. By promoting production of such rust, it is possible to suppress intrusion of generated hydrogen into the steel sheet, and it is possible to sufficiently suppress assisted cracking due to hydrogen even when the steel sheet is used under a severe corrosive environment, for example, in the presence of chloride. Since Cr is an element effective for the delayed fracture resistance of the steel sheet similarly to B and Ti, Cr can be added in an amount that does not affect formability such as the strength and elongation of the steel sheet. In order to allow these effects to be effectively exhibited, the Cr content is preferably more than 0 mass %, more preferably 0.003 mass % or more, and still more preferably 0.01 mass % or more. On the other hand, when the Cr content is excessive, formability such as the elongation of the steel sheet may deteriorate. Thus, the Cr content is preferably 1.0 mass % or less, more preferably 0.8 mass % or less, and still more preferably 0.6 mass % or less.

[Cu: Preferably More than 0 Mass % and 1.0 Mass % or Less]

Similarly to Cr, Cu is an element that is effective for improving the strength of the steel sheet, has the action of suppressing generation of hydrogen due to corrosion of the steel sheet, and improves the corrosion resistance of the steel sheet. Cu also has an action of promoting the production of iron oxide, similarly to Cr. In order to allow these effects to be effectively exhibited, the Cu content is preferably more than 0 mass %, more preferably 0.003 mass % or more, and still more preferably 0.05 mass % or more. From the viewpoint of the formability of the steel sheet, the Cu content is preferably 1.0 mass % or less, more preferably 0.8 mass % or less, and still more preferably 0.5 mass % or less.

[Ni: Preferably More than 0 Mass % and 1.0 Mass % or Less]

Similarly to Cr and Cu, Ni is an element that is effective for improving the strength of the steel sheet, has the action of suppressing generation of hydrogen due to corrosion of the steel sheet, and improves the corrosion resistance of the steel sheet. Ni also has the action of promoting the production of iron oxide, similarly to Cr and Cu. In order to allow these effects to be effectively exhibited, the Ni content is preferably more than 0 mass %, more preferably 0.003 mass % or more, and still more preferably 0.05 mass % or more. From the viewpoint of the formability of the steel sheet, the Ni content is preferably 1.0 mass % or less, more preferably 0.8 mass % or less, and still more preferably 0.5 mass % or less.

[Ti: Preferably More than 0 Mass % and 0.15 Mass % or Less]

Similarly to Cr, Cu, and Ni, Ti is an element that is effective for improving the strength of the steel sheet, has the action of suppressing generation of hydrogen due to corrosion of the steel sheet, and improves the corrosion resistance of the steel sheet. Ti also has the action of promoting the production of iron oxide, similarly to Cr, Cu, and Ni. Since Ti is an element effective for the delayed fracture resistance of the steel sheet similarly to B and Cr, Ti can be added in an amount that does not affect formability such as the strength and elongation of the steel sheet. In order to allow these effects to be effectively exhibited, the Ti content is preferably more than 0 mass %, more preferably 0.003 mass % or more, and still more preferably 0.05 mass % or more. From the viewpoint of the formability of the steel sheet, the Ti content is preferably 0.15 mass % or less, more preferably 0.12 mass % or less, and still more preferably 0.10 mass % or less.

[Nb: Preferably More than 0 Mass % and 0.15 Mass % or Less]

Nb is an element that is effective for improving the strength of the steel sheet, and acts on improving the toughness of the steel sheet by miniaturizing austenite grains after quenching. In order to allow such an effect to be effectively exhibited, the Nb content is preferably more than 0 mass %, more preferably 0.03 mass % or more, and still more preferably 0.005 mass % or more. On the other hand, when the Nb content is excessive, a large amount of carbide, nitride, or carbonitride is generated, and the formability or delayed fracture resistance of the steel sheet may deteriorate. Thus, the Nb content is preferably 0.15 mass % or less, more preferably 0.12 mass % or less, and still more preferably 0.10 mass % or less.

[V: Preferably More than 0 Mass % and 0.15 Mass % or Less]

Similarly to Nb, V is an element that is effective for improving the strength of the steel sheet, and acts on improving the toughness of the steel sheet by miniaturizing austenite grains after quenching. In order to allow such an effect to be effectively exhibited, the V content is preferably more than 0 mass %, more preferably 0.03 mass % or more, and still more preferably 0.005 mass % or more. On the other hand, when the V content is excessive, similarly to Nb, a large amount of carbide, nitride, or carbonitride is generated, and the formability or delayed fracture resistance of the steel sheet may deteriorate. Thus, the V content is preferably 0.15 mass % or less, more preferably 0.12 mass % or less, and still more preferably 0.10 mass % or less.

[B: Preferably More than 0 Mass % and 0.005 Mass % or Less]

B is an element useful for improving the hardenability and weldability of the steel sheet. Since B is an element effective for the delayed fracture resistance of the steel sheet similarly to Ti and Cr, B can be added in an amount that does not affect formability such as the strength and elongation of the steel sheet. In order to allow these effects to be effectively exhibited, the B content is preferably more than 0 mass %, more preferably 0.0002 mass % or more, still more preferably 0.0003 mass % or more, and particularly preferably 0.0004 mass % or more. On the other hand, when the B content is excessive, such an effect may be saturated, and the ductility may be reduced to deteriorate the formability. Thus, the B content is preferably 0.005 mass % or less, more preferably 0.004 mass % or less, and still more preferably 0.003 mass % or less.

[N: Preferably More than 0 Mass % and 0.01 Mass % or Less]

N is an element inevitably present as an impurity element. When the N content is excessive, a nitride may be formed to deteriorate the formability of the steel sheet. In particular, when the steel sheet contains B for improving the hardenability, N bonds with B to form a BN precipitate, and inhibits the hardenability improving action of B. Thus, the N content is preferably 0.01 mass % or less, more preferably 0.008 mass % or less, and still more preferably 0.005 mass % or less.

In the chemical composition of the steel raw material in the present embodiment, in addition to the above components, other known optional components may be further contained as long as the strength and sufficient formability are not impaired.

[Balance]

The balance is Fe and inevitable impurities. It is permitted to mix, as inevitable impurities, trace elements (e.g., As, Sb, Sn, etc.) incorporated according to the conditions of raw materials, materials, manufacturing facilities and the like. P, S, and N as described above are usually preferred as the content is smaller, and thus can be said to be inevitable impurities. However, these elements are defined as described above since the present invention can exert its effect by suppressing the content thereof to a specific range. Thus, in the present specification, "inevitable impurities" constituting the balance mean the concept excluding elements whose composition range is defined.

According to the manufacturing method according to the present embodiment, since a high Si-containing steel raw material having a Si content of 1 mass % or more is used, a hot-dip galvanized steel sheet and a hot-dip galvannealed steel sheet having high-strength and high-formability can be manufactured at low cost, and the plating adhesion in the coil width direction can be improved. Thus, in the hot-dip galvannealed steel sheet, the plating is not peeled off even in the vicinity of the width direction edge of the steel sheet. More specifically, the hot-dip galvanized steel sheet and the hot-dip galvannealed steel sheet to be manufactured may have a tensile strength of 980 MPa or more.

In addition, as described above, by continuously performing the oxidation treatment, the reduction treatment, the hot-dip galvanizing treatment, and the alloying treatment in a series of manufacturing lines using the continuous hot-dip galvanizing line, a high-strength and high-formability hot-dip galvannealed steel sheet having good plating adhesion can be manufactured inexpensively and efficiently while product quality is maintained.

Although the overview of the present invention has been described above, the method for manufacturing a hot-dip galvanized steel sheet and the method for manufacturing a hot-dip galvannealed steel sheet according to the embodiment of the present invention are summarized as follows.

A method for manufacturing a hot-dip galvanized steel sheet according to a first aspect of the present invention includes the steps of:

hot-rolling a steel raw material having a Si content of 1.0 mass % or more and coiling a steel sheet at 500° C. to 700° C.;

subjecting a surface of the steel sheet after the coiling to an oxidation treatment at a heating temperature of a steel sheet temperature of 750° C. or lower, and subsequently subjecting the surface to a reduction treatment; and subjecting the steel sheet after the reduction treatment to a hot-dip galvanizing treatment to form a Zn-plated layer on a surface of the steel sheet.

The method for manufacturing a hot-dip galvanized steel sheet preferably further includes a step of annealing the steel sheet at a soaking temperature of 540° C. to 620° C. under the non-reducing atmosphere between the coiling and the oxidation treatment.

A method for manufacturing a hot-dip galvannealed steel sheet according to a second aspect of the present invention further includes a step of alloying the Zn-plated layer formed on the hot-dip galvanized steel sheet obtained by the method for manufacturing a hot-dip galvanized steel sheet according to the first aspect described above.

EXAMPLES

Hereinafter, the present invention will be described more specifically with reference to examples, but the present invention is not limited by the examples at all.

Example 1

In Example 1, a hot-dip galvanized steel sheet and a hot-dip galvannealed steel sheet as an example of the present invention were manufactured, and the plating adhesion in the manufactured hot-dip galvanized steel sheet was evaluated.

[Manufacturing of Hot-Dip Galvanized Steel Sheet and Hot-Dip Galvannealed Steel Sheet]

A steel material of a steel grade A having a chemical composition shown in Table 1 below was produced by a converter, and then a slab was manufactured by continuous casting. The obtained slab was hot-rolled to a sheet thickness of 2.0 mm at a finish rolling end temperature of 900° C., and coiled at 640° C. as shown in Table 2 below, and the obtained hot-rolled steel sheet was cooled to normal temperature. Thereafter, the hot-rolled steel sheet was charged into an annealing furnace and annealed. As annealing conditions, under a non-reducing atmosphere of N2-less than 0.9 vol % H2, the temperature of the hot-rolled steel sheet was increased to 580° C. for about 8.5 hours, soakingly retained at 580° C. for 30 hours, and then cooled to 200° C. or less for about 5 hours. Thereafter, the annealed steel sheet obtained was pickled by immersing the steel sheet at 85° C. for 40 seconds using hydrochloric acid having a concentration of 8 wt %. Finally, cold rolling was performed until the sheet thickness of the annealed steel sheet was changed from 2.0 mm to 1.4 mm. Subsequently, using the steel sheet thus manufactured, the oxidation treatment, the reduction treatment, the hot-dip galvanizing treatment, and the alloying treatment were performed by applying the continuous hot-dip galvanizing line having the NOF-type annealing furnace. In the oxidation treatment, the steel sheet was heated to a steel sheet temperature of 716° C. in a temperature rise time of 45 seconds under a combustion exhaust gas atmosphere containing less than 17,000 ppm of $O_2$ and $CO_2$, $N_2$, and $H_2O$.

Here, the "steel sheet temperature" means the maximum reached sheet temperature of the steel sheet whose heating is controlled in the oxidation heating zone of the NOF-type (or DFF-type in Examples 2 and 3 described later) annealing furnace.

In the reduction treatment, the oxidized steel sheet was heated at a soaking temperature of about 800° C. (800° C. to 900° C.) for about 60 seconds (50 seconds to 60 seconds) under a gas atmosphere of $N_2$—$H_2$. In the hot-dip galvanizing treatment, the steel sheet after reduction was immersed in the Zn-plating bath at 430° C. to form a hot-dip galvanizing layer. The hot-dip galvanized steel sheet was thus obtained, and then a hot-dip galvannealed steel sheet was obtained by alloying treatment.

[Evaluation of Plating Adhesion of Hot-Dip Galvanized Steel Sheet]

The plating adhesion of the obtained hot-dip galvannealed steel sheet was evaluated. Specifically, using the obtained hot-dip galvannealed steel sheet, a hat-shaped molded member was molded by a crank press under the following conditions, and a plating peeling state of a sliding surface of a side wall of the molded member was visually determined. An evaluation sample was cut so as to include a position of 50 mm to 100 mm from the width direction edge in the vicinity of the rear end in the rolling direction of the obtained hot-dip galvannealed steel sheet. Specific evaluation criteria are also shown below. The evaluation results of the plating adhesion of the hot-dip galvanized steel sheet of Example 1 are summarized in Table 2 below together with the manufacturing conditions of the steel sheet.

(Conditions of Crank Press)

Size of evaluation sample: width 40 mm×length 250 mm
Die width: 52 mm
Die shoulder radius: 2 mm
Punch width: 48 mm
Punch shoulder radius: 5 mm
Bead: present
Bead tip radius: 2 mm
Bead height: 3 mm
Molding height: 60 mm
(Evaluation criteria for plating adhesion)
○: clear peeling is not observed in the plating layer
x: flaky floating is observed in the plating layer

Example 2

In Example 2, a hot-dip galvanized steel sheet and a hot-dip galvannealed steel sheet were manufactured by the same method as in Example 1 described above except that a steel material having a chemical composition of a steel grade C shown in Table 1 below was used, a hot rolling coiling temperature was set to 660° C., the continuous hot-dip galvanizing line having the DFF-type annealing furnace was applied, the oxidation treatment, the reduction treatment, the hot-dip galvanizing treatment, and the alloying treatment were performed, the steel sheet temperature of the oxidation heating zone in the DFF-type annealing furnace was set to 671° C., the soaking temperature in the reduction treatment was set to about 900° C. (900° C. to 950° C.), and the soaking time was set to about 300 seconds (240 seconds to 360 seconds). In addition, the plating adhesion was also evaluated in the same manner. The evaluation results of the plating adhesion of the hot-dip galvanized steel sheet of Example 2 are also summarized in Table 2 below together with the manufacturing conditions of the steel sheet.

Example 3

In Example 3, a hot-dip galvanized steel sheet and a hot-dip galvannealed steel sheet were manufactured by the same method as in Example 2 described above except that a steel material having a chemical composition of a steel grade D shown in Table 1 below was used and the steel sheet temperature in the oxidation heating zone in the DFF-type annealing furnace was set to 679° C. In addition, the plating adhesion was also evaluated in the same manner. The evaluation results of the plating adhesion of the hot-dip galvanized steel sheet of Example 3 are also summarized in Table 2 below together with the manufacturing conditions of the steel sheet.

Comparative Example 1

In Comparative Example 1, a hot-dip galvanized steel sheet and a hot-dip galvannealed steel sheet were manufactured by the same method as in Example 1 described above except that a steel material having a chemical composition of a steel grade B shown in Table 1 below was used, the hot rolling coiling temperature was 550° C., and the steel sheet temperature in the oxidation heating zone in the NOF-type annealing furnace was set to 906° C. In addition, the plating adhesion was also evaluated in the same manner. The evaluation results of the plating adhesion of the hot-dip galvanized steel sheet of Comparative Example 1 are also summarized in Table 2 below together with the manufacturing conditions of the steel sheet.

TABLE 1

| | Chemical composition (wt %) | | | | | | |
|---|---|---|---|---|---|---|---|
| Steel grade | Si | Mn | C | P | S | Al | Cr |
| A | 1.83 | 2.00 | 0.22 | 0.009 | 0.0005 | 0.05 | 0.20 |
| B | 1.87 | 2.01 | 0.22 | 0.010 | 0.0005 | 0.04 | 0.19 |
| C | 1.39 | 2.01 | 0.21 | 0.007 | 0.0006 | 0.04 | 0.50 |
| D | 1.64 | 2.19 | 0.21 | 0.007 | 0.0005 | 0.44 | 0.03 |

TABLE 2

| | Category | Steel grade | Hot rolling coiling temperature (° C.) | Annealing condition Soaking temperature × soaking time | Annealing furnace | Steel sheet temperature during heating in oxidation treatment (° C.) | Plating adhesion |
|---|---|---|---|---|---|---|---|
| Example 1 | Present invention example | A | 640 | 580° C. × 30 hours | NOF type | 716 | ○ |
| Example 2 | Present invention example | C | 660 | 580° C. × 30 hours | DFF type | 671 | ○ |

TABLE 2-continued

| | Category | Steel grade | Hot rolling coiling temperature (° C.) | Annealing condition Soaking temperature × soaking time | Annealing furnace | Steel sheet temperature during heating in oxidation treatment (° C.) | Plating adhesion |
|---|---|---|---|---|---|---|---|
| Example 3 | Present invention example | D | 660 | 580° C. × 30 hours | DFF type | 679 | ○ |
| Comparative Example 1 | Comparative Example | B | 550 | 580° C. × 30 hours | NOF type | 906 | X |

(Consideration)

As shown in Table 2 above, the hot-dip galvanized steel sheets of Example 1 in which the heating temperature in the hot-dip galvanizing line was 716° C., Example 2 in which the heating temperature was 671° C., and Example 3 in which the heating temperature was 679° C. had excellent plating adhesion. On the other hand, in the hot-dip galvanized steel sheet of Comparative Example 1, even if the annealing conditions before pickling were the same as those in Examples 1, 2, and 3, the heating temperature in the hot-dip galvanizing line was high and deviated from the specified temperature in the present embodiment, and therefore the plating adhesion was poor. This is considered to be because, in Comparative Example 1, the steel sheet temperature during heating in the oxidation treatment was too high, so that a thick fayalite layer was formed between the steel sheet and the plating.

The present application is based on Japanese Patent Application No. 2021-036226 filed on Mar. 8, 2021 and Japanese Patent Application No. 2022-014412 filed on Feb. 1, 2022, the contents of which are incorporated herein.

It should be understood that the embodiments and examples disclosed herein are exemplary in all respects and do not pose any limitation. The scope of the present invention is indicated by the scope of claims instead of the above description, and is intended to include meanings equivalent to the scope of claims and all modifications within the scope.

INDUSTRIAL APPLICABILITY

According to the present invention, it is possible to manufacture a hot-dip galvanized steel sheet having good plating adhesion even when the Si content is high. Thus, for example, it is possible to efficiently manufacture a high-strength and high-formability hot-dip galvanized steel sheet and a hot-dip galvannealed steel sheet having a tensile strength of 980 MPa or more, which are suitably applied to an automobile member such as an automobile body.

The invention claimed is:

1. A method for manufacturing a hot-dip galvanized steel sheet comprising:

hot-rolling a steel raw material having a Si content of 1.0 mass % or more to obtain a steel sheet;

coiling the steel sheet at 500° C. to 700° C.;

cooling the coiled steel sheet to normal temperature;

annealing the coiled steel sheet, after the cooling to normal temperature, at a soaking temperature of 540° C. to 620° C. under a non-reducing atmosphere;

pickling the annealed steel sheet so that a pickling reduction amount in the steel sheet after removing the scale is less than 31 g/m$^2$;

subjecting a surface of the steel sheet after the pickling to an oxidation treatment at a heating temperature of a steel sheet temperature of 750° C. or lower, and subsequently subjecting the surface to a reduction treatment; and subjecting the steel sheet after the reduction treatment to a hot-dip galvanizing treatment to form a Zn-plated layer on a surface of the steel sheet.

2. A method for manufacturing a hot-dip galvannealed steel sheet comprising alloying the Zn-plated layer formed on the hot-dip galvanized steel sheet obtained by the method for manufacturing a hot-dip galvanized steel sheet according to claim 1.

3. The method for manufacturing a hot-dip galvanized steel sheet according to claim 1, wherein the soaking time during the annealing is 30 hours or more.

4. A method for manufacturing a hot-dip galvanized steel sheet comprising:

hot-rolling a steel raw material having a Si content of 1.0 mass % or more to obtain a steel sheet;

coiling the steel sheet at 500° C. to 700° C.;

pickling the coiled steel sheet so that a pickling reduction amount in the steel sheet after removing the scale is less than 31 g/m$^2$;

subjecting a surface of the steel sheet after the pickling to an oxidation treatment at a heating temperature of a steel sheet temperature of 750° C. or lower, and subsequently subjecting the surface to a reduction treatment; and subjecting the steel sheet after the reduction treatment to a hot-dip galvanizing treatment to form a Zn-plated layer on a surface of the steel sheet, wherein an oxygen concentration of the oxidation treatment is in a range of from 500 ppm to 17,000 ppm.

5. The method for manufacturing a hot-dip galvanized steel sheet according to claim 4, further comprising cooling the coiled steel sheet to normal temperature; and annealing the coiled steel sheet, after the cooling to normal temperature, at a soaking temperature of 540° C. to 620° C. under a non-reducing atmosphere before the pickling.

6. A method for manufacturing a hot-dip galvanized steel sheet comprising:

hot-rolling a steel raw material having a Si content of 1.0 mass % or more to obtain a steel sheet;

coiling the steel sheet at 500° C. to 700° C.;

cooling the coiled steel sheet to normal temperature;

annealing the coiled steel sheet, after the cooling, at a soaking temperature of 540° C. to 620° C. under a non-reducing atmosphere of $N_2$ having less than 1.0 vol % $H_2$ or Ar;

subjecting a surface of the steel sheet after the annealing to an oxidation treatment at a heating temperature of a steel sheet temperature of 750° C. or lower, and subsequently subjecting the surface to a reduction treatment; and subjecting the steel sheet after the reduction treatment to a hot-dip galvanizing treatment to form a Zn-plated layer on a surface of the steel sheet.

* * * * *